US005781936A

United States Patent [19]

Alaloof

[11] Patent Number: 5,781,936

[45] Date of Patent: Jul. 21, 1998

[54] PROJECTION SYSTEM FOR THE RIDER OF A NON-ENCLOSED VEHICLE AND VEHICLE INCORPORATING SAME

[76] Inventor: Jacob Alaloof, 4 Amnon Vetamar Street, Herzlia, Israel

[21] Appl. No.: 545,938

[22] Filed: Oct. 20, 1995

[30] Foreign Application Priority Data

Mar. 22, 1995 [IL] Israel ..... 113081

[51] Int. Cl.[6] ..... A41D 13/00

[52] U.S. Cl. ..... 2/456; 2/DIG. 3; 280/728.1

[58] Field of Search ..... 2/2, DIG. 3, 455, 2/456, 459, 463, 464, 465, 467; 280/728 R, 730 R, 733, 728.1, 730.1, 734, 736

[56] References Cited

U.S. PATENT DOCUMENTS

| | | | |
|---|---|---|---|
| 3,921,944 | 11/1975 | Morrison | 2/2 |
| 4,059,852 | 11/1977 | Crane . | |
| 4,089,065 | 5/1978 | McGee | 2/2 |
| 4,637,074 | 1/1987 | Taheri . | |
| 4,685,151 | 8/1987 | Kincheloe . | |
| 4,977,623 | 12/1990 | DeMarco | 2/2 |
| 4,984,821 | 1/1991 | Kim et al. | 2/2 |
| 5,091,992 | 3/1992 | Pusic | 2/2 |
| 5,133,084 | 7/1992 | Martin | 2/2 |
| 5,313,670 | 5/1994 | Archer, III | 2/2 |
| 5,402,535 | 4/1995 | Green | 2/2 |
| 5,500,952 | 3/1996 | Keyes | 2/2 |
| 5,535,446 | 7/1996 | Pusic | 2/2 |

FOREIGN PATENT DOCUMENTS

| | | |
|---|---|---|
| 2677856 | 12/1992 | France . |
| 3323701 | 1/1984 | Germany . |
| 84/9018 | 5/1985 | South Africa . |
| 1479733 | 7/1977 | United Kingdom . |
| 1588919 | 4/1981 | United Kingdom . |
| 2099687 | 12/1982 | United Kingdom . |

*Primary Examiner*—Michael A. Neas
*Attorney, Agent, or Firm*—Choate, Hall & Stewart

[57] ABSTRACT

A protective system for the rider of a non-enclosed vehicle including a garment-shaped inflatable member for surrounding at least upper portions of the body of the rider, a source of pressurized gas, and apparatus for exposing the interior of the inflatable member to the pressurized gas source for rapidly inflating the inflatable member in response to a sudden separation of the rider from the vehicle by at least a predetermined distance, wherein the inflatable member has a garment-shaped configuration when in a non-inflated orientation, and which when inflated, has an expanded, generally bulbous configuration such that large magnitude concentrated forces experienced thereby on impact with an object subsequent to the sudden separation of the rider from the vehicle are prevented from transfer directly to the rider, thereby protecting the surrounded upper portions of the rider's body from serious injury.

16 Claims, 13 Drawing Sheets

PROJECTION SYSTEM FOR THE RIDER OF A NON-ENCLOSED VEHICLE AND VEHICLE INCORPORATING SAME

FIELD OF THE INVENTION

The present invention relates to protective gear for users of non-enclosed vehicles, such as motorcycles.

BACKGROUND OF THE INVENTION

It is generally recognized that there is a greater risk of serious injury to motorcyclists in the case of an accident than to automobile passengers. This is due, inter alia, to the fact that, unlike automobiles, motorcycles are not equipped with protective systems which enclose users thereof. Accordingly, apart from injuries that may be caused to a motorcyclist by his colliding directly with a moving vehicle or stationary object, there is also a very high risk that, in the event of a collision between a motorcycle and either another vehicle or a stationary object, he will be thrown from the motorcycle. When this happens, the motorcyclist is liable to sustain fatal injuries or, at least, very serious damage to vital parts of the body, especially to the back, spine, neck and pelvis. This can result in very serious injury thereto, if not paralysis or death.

This problem has been well recognized in the art, although no satisfactory solution has been proposed hitherto. An indication of the state of the art is found in a plurality of publications, as briefly described below.

French Patent Application No. 9107659, Publication No. 2,677,856, to Demarais, discloses a protective garment for a motorcyclist. The garment incorporates inflatable chambers preferably made of natural or synthetic rubber linked to a compressed air supply to protect the rider in event of a fall.

South African Patent Application No. 8409018 to Van Wyk discloses a safety garment for a motorcyclist. The garment is connected to a fluid pressure source and is adapted to inflate on deceleration of the vehicle or the wearer.

German Patent Application No. DE 3323701 to Hasse discloses a safety jacket for motorcyclists and pedestrians which is made of double-layered inflatable material with a rip cord.

UK Patent Application No. 2,099,687 to Sweeney discloses a protective garment for a motorcyclist, wherein the garment has compartments that are rapidly inflatable from a compressed gas source.

U.S. Pat. No. 4,059,852 to Crane discloses an inflatable suit for motorcyclists, wherein the suit has a pressurized gas supply associated with an ingress port. A valve associated with the gas supply is adapted for activation on an abrupt separation of the motorcyclist from his vehicle.

The above publications are characterized, inter alia, by their disclosure of garments which inflate rapidly upon separation of a wearer from a motorcycle so as to provide cushioning to certain regions of the body. The inflated shape approximates to the non-inflated shape of the garment, although with some thickening in places. Accordingly, while some protection may be provided by the garment upon inflation thereof, there occurs relatively little redistribution of the forces experienced upon impacting the ground after a person is propelled from his motorcycle, and thus little significant protection against direct impact forces is provided thereby. Accordingly, impact forces are not necessarily reduced significantly enough so as to prevent serious or fatal injuries to a wearer, as described above.

U.S. Pat. No. 4,637,074 to Taheri discloses an inflatable garment, for use in a vehicle such as an automobile, for protecting against collision related injury.

SUMMARY OF THE INVENTION

The present invention seeks to provide a protective system for riders of nonenclosed vehicles. The protective system is in the form of a garment which is automatically inflated to a force dissipating or deflecting shape in response to unintentional separation of the rider from his vehicle.

There is thus provided, in accordance with a preferred embodiment of the invention, for use with a non-enclosed vehicle having a chassis and a plurality of wheels associated with the chassis, an improved protective system for the rider of the vehicle.

The protective system includes a garment-shaped inflatable member for surrounding at least upper portions of the body of the rider; a source of pressurized gas; and apparatus for exposing the interior of the inflatable member to the pressurized gas source for rapidly inflating the inflatable member in response to a sudden separation of the rider from the vehicle by at least a predetermined distance, wherein the inflatable member has a garment-shaped configuration when in a noninflated orientation, and which when inflated, has an expanded, generally bulbous configuration such that large magnitude concentrated forces experienced thereby on impact with an object subsequent to the sudden separation of the rider from the vehicle are prevented from transfer directly to the rider, thereby protecting the surrounded upper portions of the rider's body from serious injury.

Additionally in accordance with a preferred embodiment of the invention, the inflatable member includes first and second inflatable portions for covering and protecting respective front and rear portions of the body and at least a third inflatable portion for covering and protecting at least the back of the rider's neck.

Preferably, the first, second and third inflatable portions are also operative to fixate body portions surrounded thereby, when in the inflated orientation.

Further in accordance with a preferred embodiment of the invention, each of the first and second inflatable portions includes a gas impermeable interior layer configured to lay against a predetermined portion of the rider's body; a gas impermeable exterior layer connected to the interior layer so as to form therewith a substantially sealed chamber, wherein the exterior layer is formed of a flexible material which expands in the presence of an elevated gas pressure; and one or more gas impermeable walls extending laterally between and sealed to the interior and exterior layers, thereby to divide the sealed chamber into at least two gas inflatable cells.

Additionally in accordance with a preferred embodiment of the invention, the garment-shaped inflatable member is configured to cover and protect at least the portion of the body extending from the pelvis to the neck.

Further in accordance with a preferred embodiment of the invention, the non-enclosed vehicle is a motorcycle.

BRIEF DESCRIPTION OF THE DRAWINGS

The present invention will be more fully understood and appreciated from the following detailed description taken in conjunction with the drawings, in which.

DETAILED DESCRIPTION OF A PREFERRED EMBODIMENT

Figure 1:
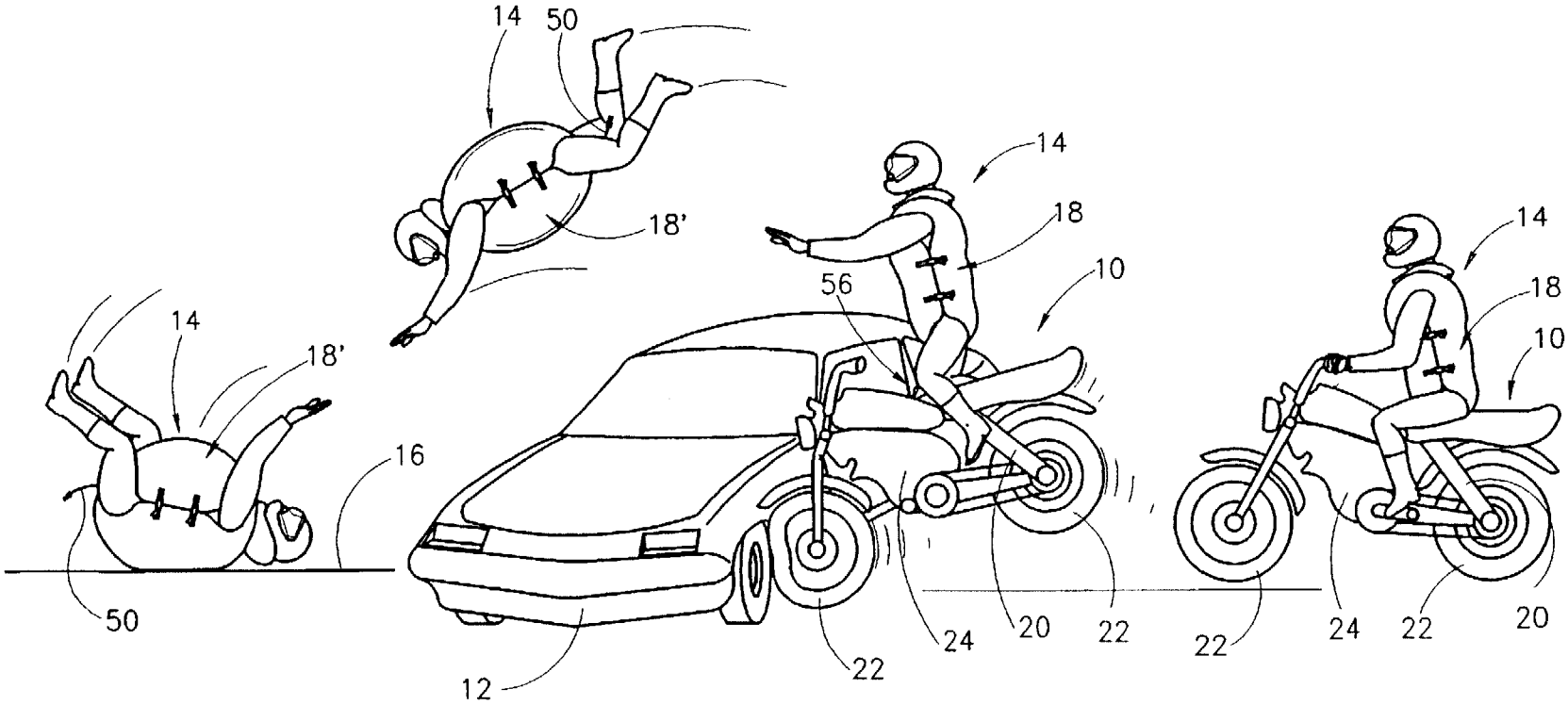
FIG. 1 is a pictorial illustration of collision between a motorcycle and an automobile, wherein the motorcyclist is protected by the protective system of the present invention.

Reference is now made to FIG. 1, wherein there is illustrated a collision between a non-enclosed vehicle, referenced 10, such as a motorcycle, and an automobile, referenced 12. It is seen that in the side-on collision, the motorcyclist, referenced 14, is ejected from the motorcycle 10, and is projected through the air until landing on a ground surface 16 on his back. Unprotected, such an occurrence could be sufficient to cause serious injuries to the neck and back of the motorcyclist, in many cases either killing him or leaving him with permanent disabilities. As will be appreciated by persons skilled in the art, among portions of the body that are most susceptible to permanent injury and even fatality, are the neck, back and pelvis.

The present invention thus provides a protective system, referenced 18, which is adapted to be worn as an outer garment and which, upon a sudden separation of the rider from his vehicle, such as is caused by a collision with another vehicle or a stationary object, for example, immediately inflates. In the inflated position, the system is indicated 18'. By the time the rider lands, his entire upper body, from his pelvis to his neck, is encased in a protective balloon-shaped cushion which operates to protect the rider from serious injury as described. This is achieved by deflection of some portion of the impact forces, and by spreading or distributing the remainder over substantially the entire protected portions of the body, thereby preventing transfer of concentrated large forces to specific portions of the body.

While, as described above, in the BACKGROUND OF THE INVENTION, various attempts have been made in the art to provide rapidly inflating cushioning devices for motorcyclists, these are all characterized by the provision of relatively thin cushioning which cannot properly either deflect or disperse impact forces.

In contrast to the prior art, the present invention utilizes the natural properties of rounded or spherical objects which, as a result of their shape, tend to be at least partially deflected from a surface upon impact therewith, thereby, in turn, to also deflect a major portion of the impact forces away from the rider. The massiveness of the inflated form of the protective system of the present invention also ensures that, once the system has been inflated, any remaining forces are spread over a much larger area of the body, as described above and, further, the neck and back are supported to the extent of being fixated, thereby preventing undesired movement of the neck and spine of an injured rider in the absence of paramedical or medical personnel.

It will be appreciated that, while the system of the present invention is intended primarily as a protective garment that is essentially an add-on system, the system requires installation on the vehicle and operates in conjunction with the vehicle—and the present invention therefore relates additionally to a non-enclosed vehicle which incorporates the system. The non-enclosed vehicle, which is typically a motorcycle 10 as seen in FIG. 1, thus includes, a chassis 20, a plurality of wheels 22 associated with the chassis, an engine 24 arranged in driving association with the wheels 22; and the protective system 18.

Figure 3G:
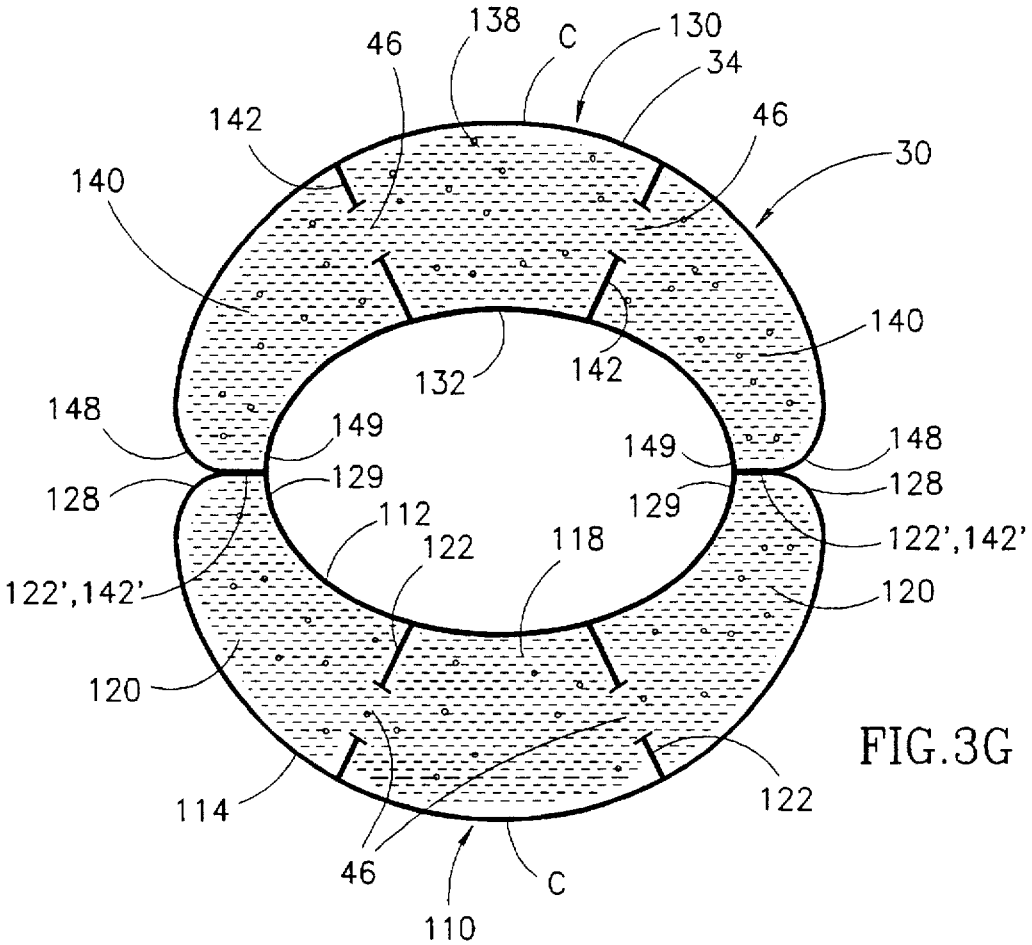
FIGS. 3A–3G are views of a motorcyclist wearing the system of the invention, similar to the views of FIGS. 2A–2F, but wherein the system is seen in an inflated orientation.
Figure 3A:
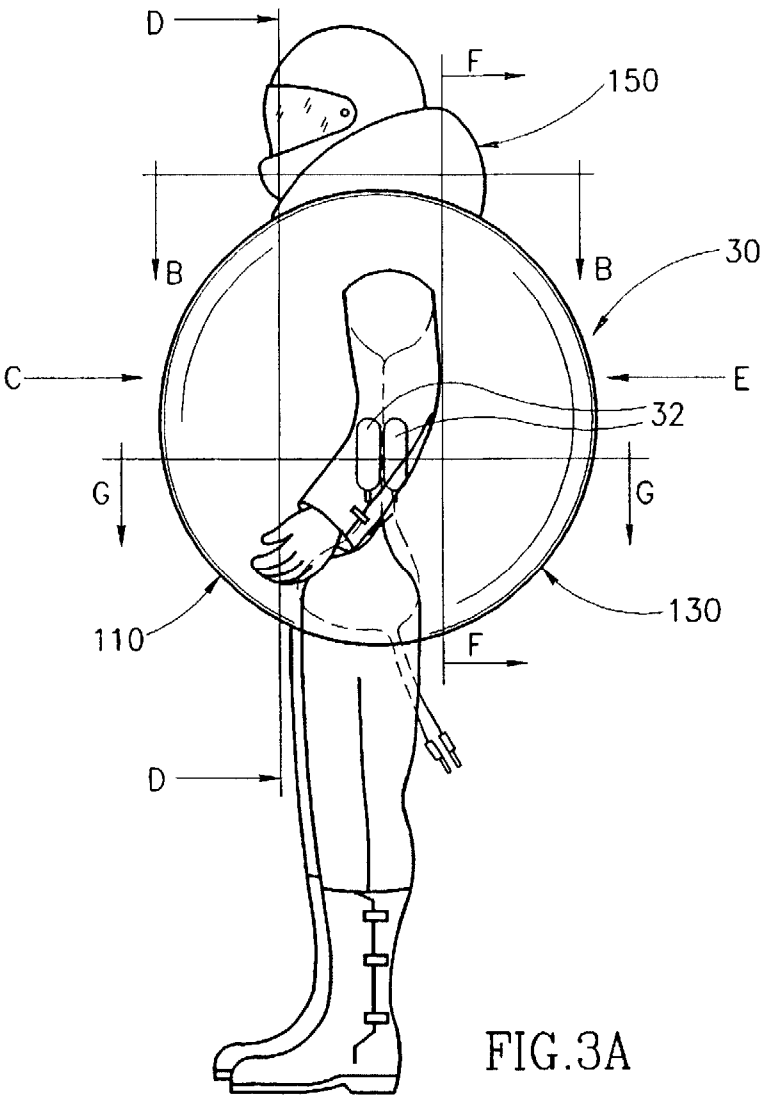
Figure 3B:
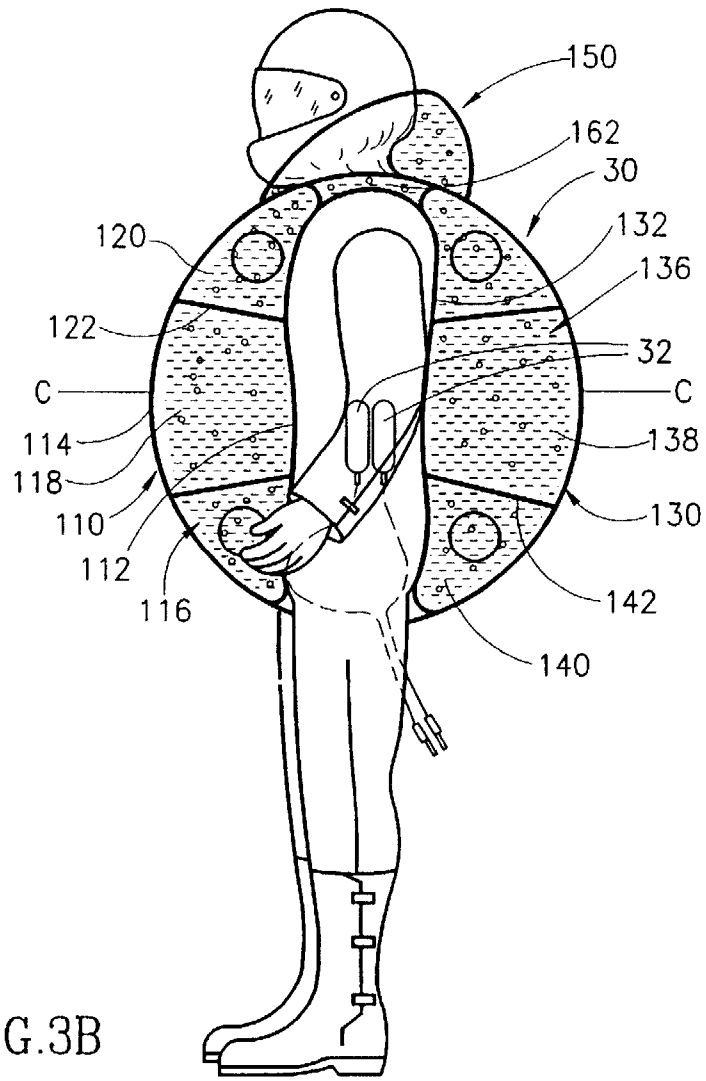
Figure 3D:
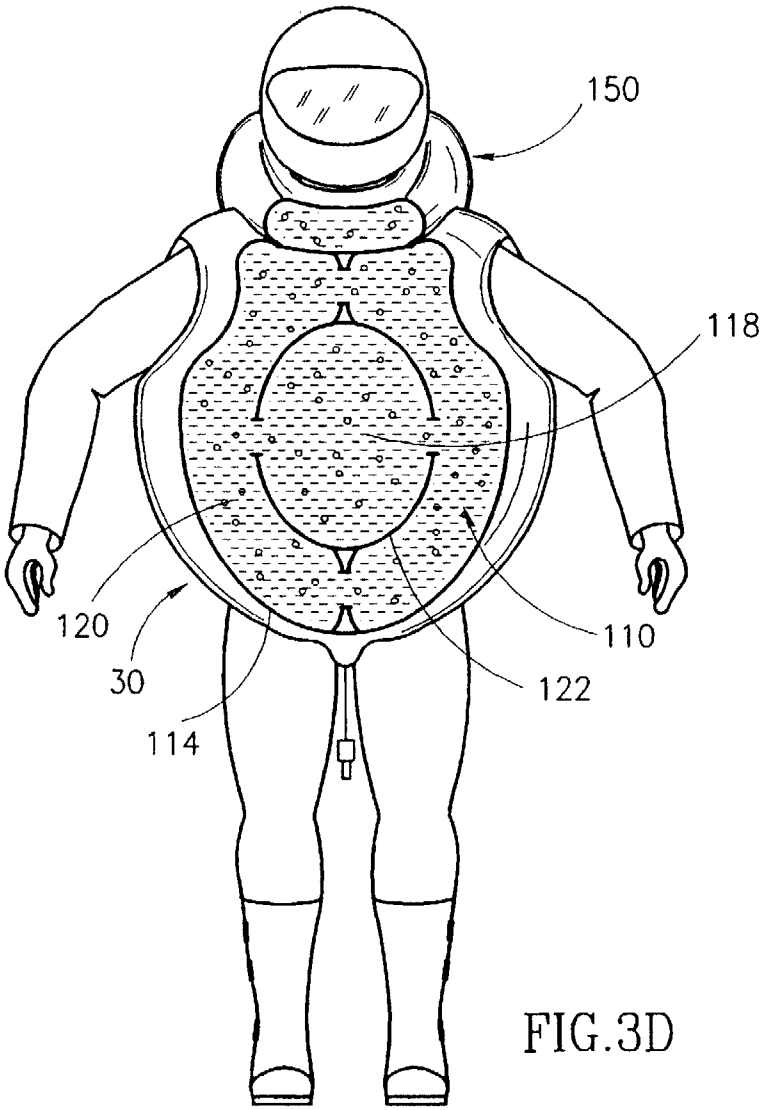
Figure 3C:
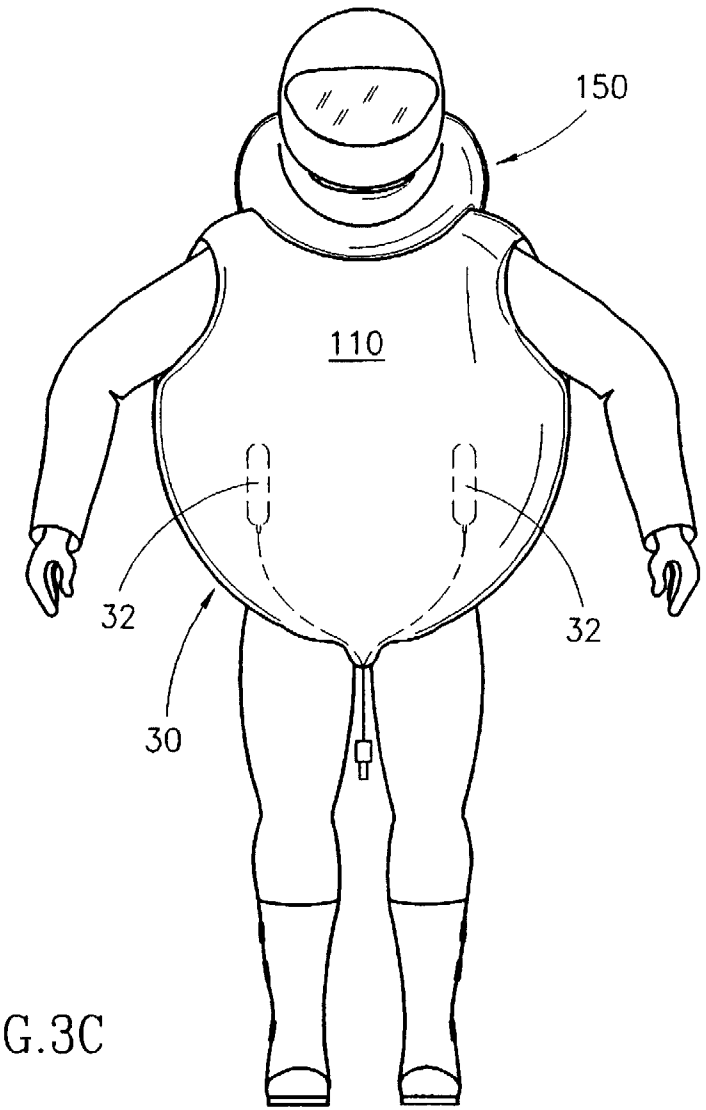
Figure 3F:
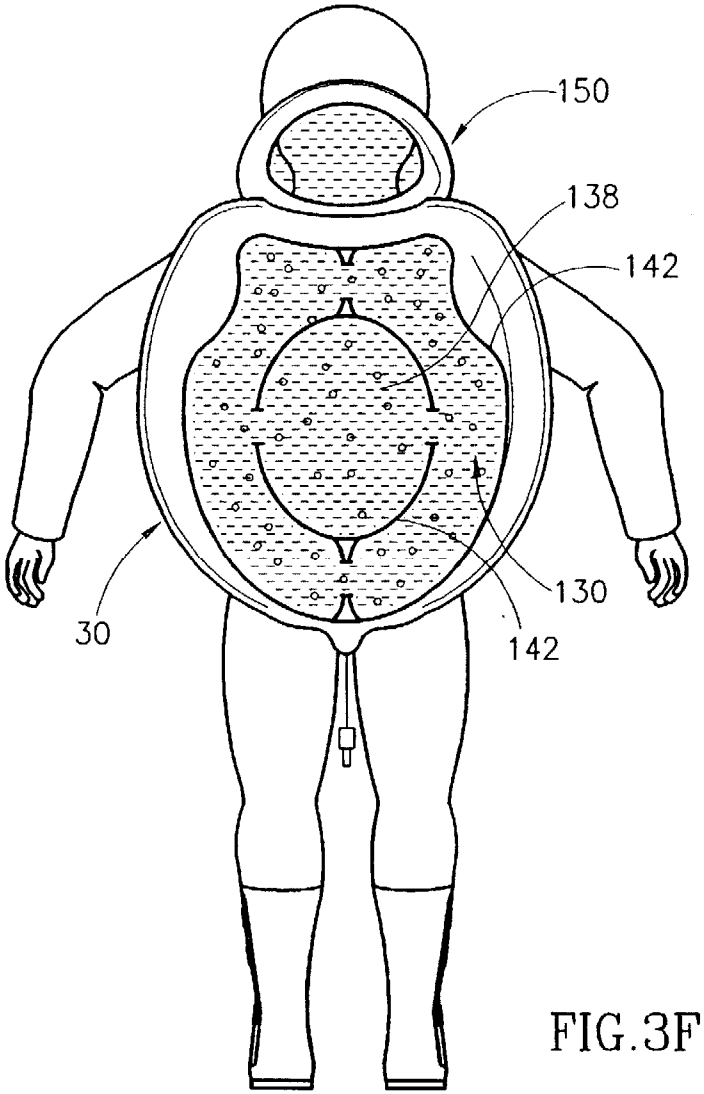
Figure 3E:
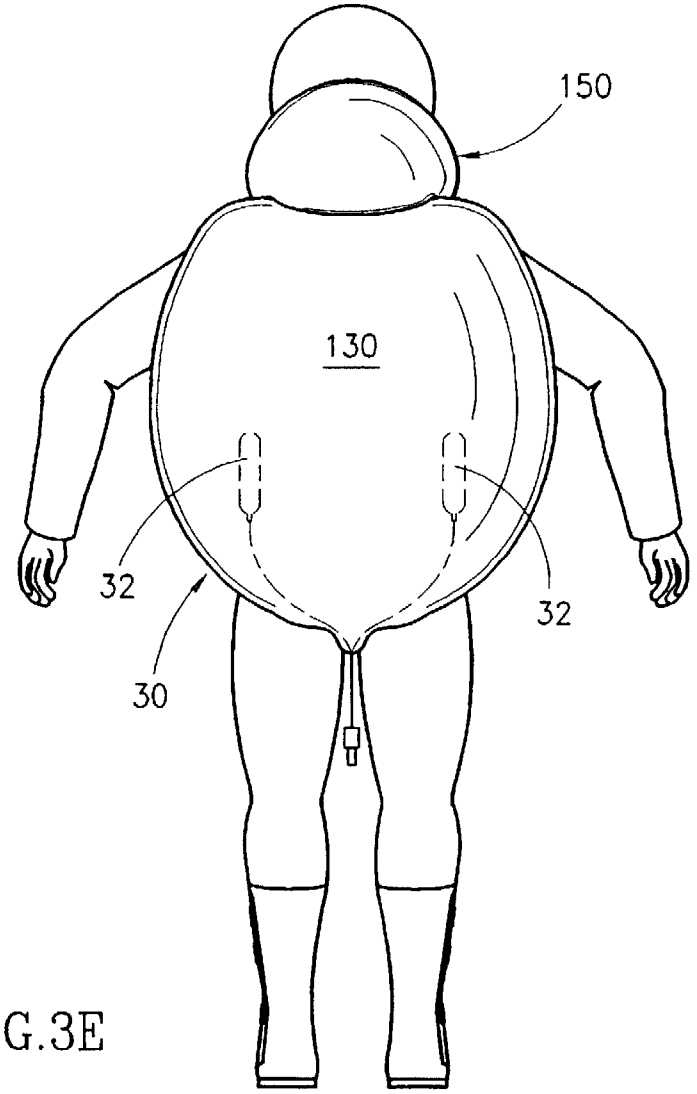
Figure 4B:
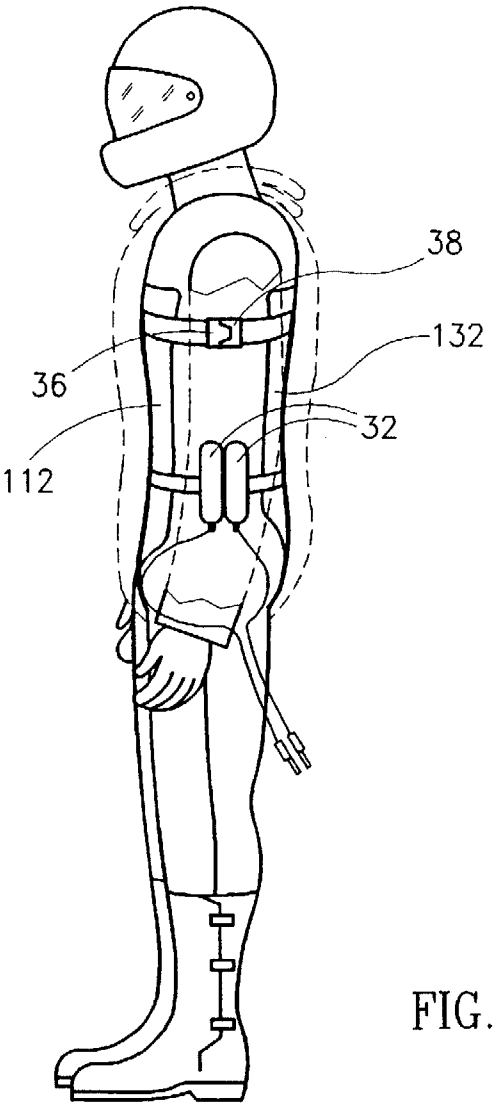
FIGS. 4A and 4B are respective front and side illustrations of the system of the invention in a non-inflated orientation and being worn by a wearer, wherein the exterior of the system is cut away so as to show the interior thereof.
Figure 4A:
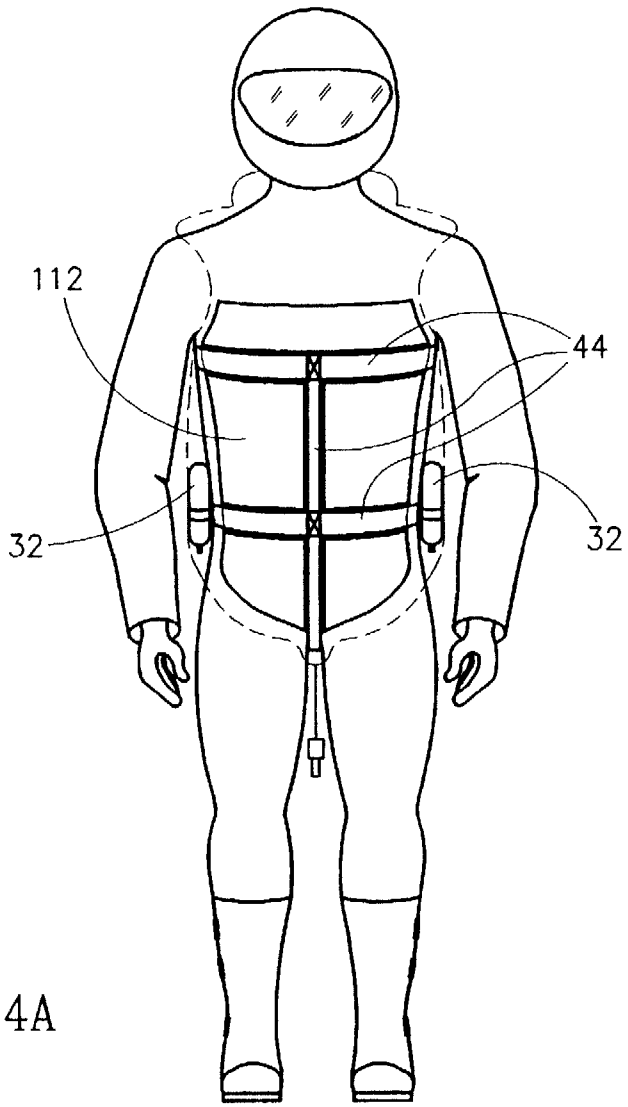
Figure 5:
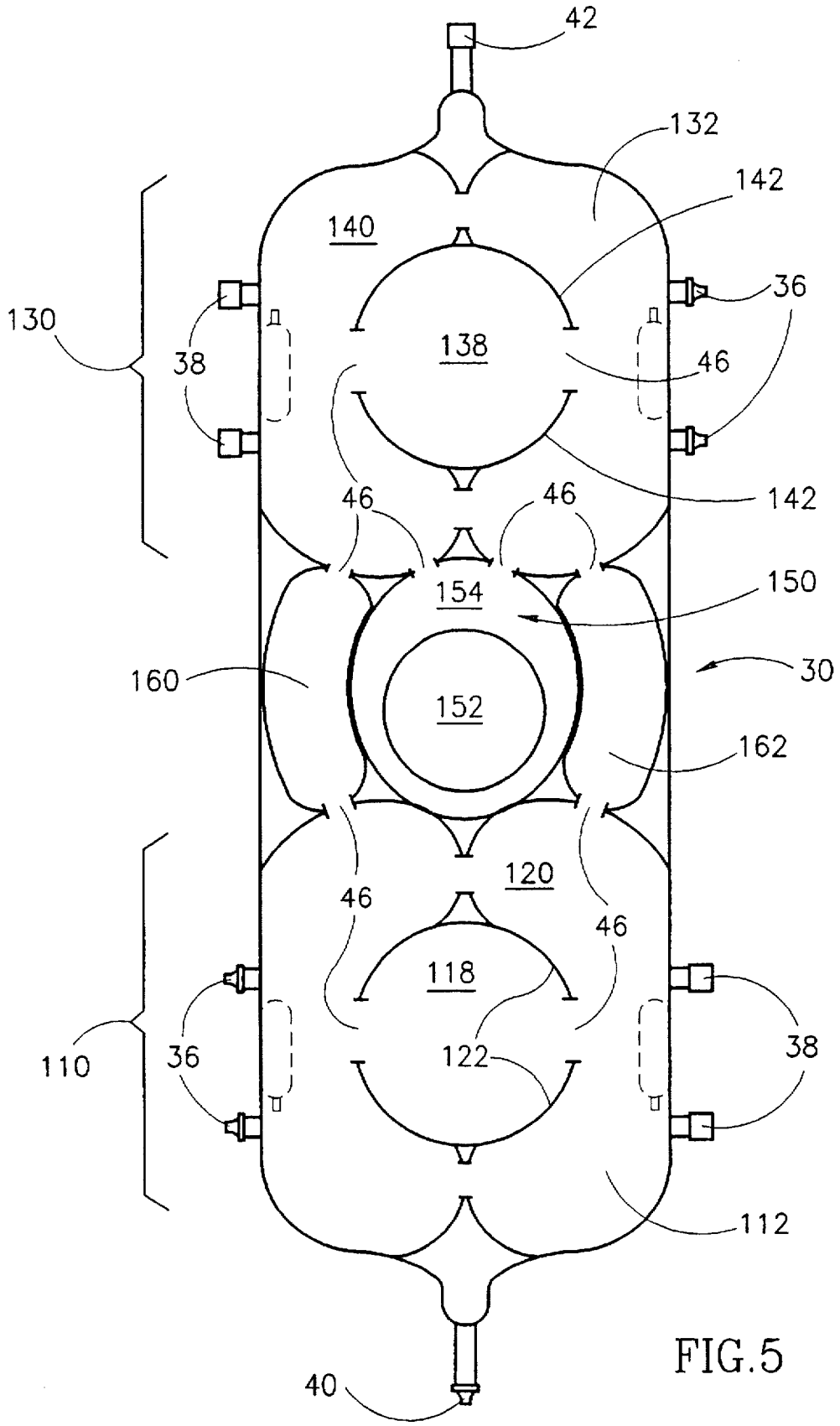
FIG. 5 is a schematic diagram of the system of the invention in a spread-out position, illustrating the intercommunicating inflatable chambers of the system.

Reference is now made to FIGS. 2A–5, of which FIGS. 2A–2G show the protective system 18 worn on rider 14, in a non-inflated orientation; FIGS. 3A–3G show system 18 in an inflated orientation; FIGS. 4A and 4B show the interior layer only of system 18; and FIG. 5 is a schematic cut-away view of system 18 in a spread-out position, showing the intercommunication between different portions thereof.

As seen, the main portion of protective system 18 is a garment-shaped inflatable member 30 which preferably surrounds the entire upper portion of the body from the pelvis to the neck, thereby, when inflated, providing all round protection and support. Inflatable member 30 has located therein a source of pressurized gas, preferably in the form of a plurality of pressurized gas canisters, referenced 32, preferably containing compressed air. So as to minimize the time that it takes to inflate inflatable member 30, the canisters 32 are located inside the inflatable member, and they are operated by a gas release mechanism, seen at 34. Both the gas canisters 32 and the gas release mechanisms 34 used in conjunction therewith are for one-time use and may be as used in lifejackets, for example, and they are therefore not described herein in detail. The gas release mechanism 34 is operative to rapidly inflate the inflatable member 30 in response to a sudden separation of the rider 14 from the vehicle by at least a predetermined distance which would occur as a result of a collision, as described. The succession of events starting with separation of the rider from his vehicle by a predetermined distance and leading to inflation of the inflatable member 30 and complete separation of the vehicle, are described below in conjunction with FIGS. 6A–6C.

It will be appreciated that, in order to encourage riders to use the system of the present invention, inflatable member 30 is preferably lightweight and has a garment-shaped configuration when in a non-inflated orientation. However, once inflated, in order to deflect at least a major portion of any impact forces and thereby to prevent serious injury to the rider, inflatable member 30 adopts a bulbous or generally rounded, spherical or elliptical balloon shape.

As seen in the drawings, inflatable member 30 typically has first and second inflatable portions, respectively referenced 110 and 130, for covering and protecting respective front and rear portions of the body, and a third inflatable portion, referenced 150, for covering and protecting at least the back of the rider's neck, but preferably for substantially surrounding the neck.

In order to ensure continuity about the shoulders of the cushion constituted by member 30, and so as to provide rapid gas communication throughout member 30 upon release of the gas from canisters 32, member 30 is provided, in the present embodiment, in an apron-like arrangement, there also preferably being provided a pair of inflatable cells 160 and 162 across the shoulders, seen in FIGS. 3B and 5. It is also seen in FIG. 5 that first and second portions 110 and 130 are arranged symmetrically about and connected via third portion 150, in which there is provided an opening 152 for insertion of the rider's head.

Figure 2A:
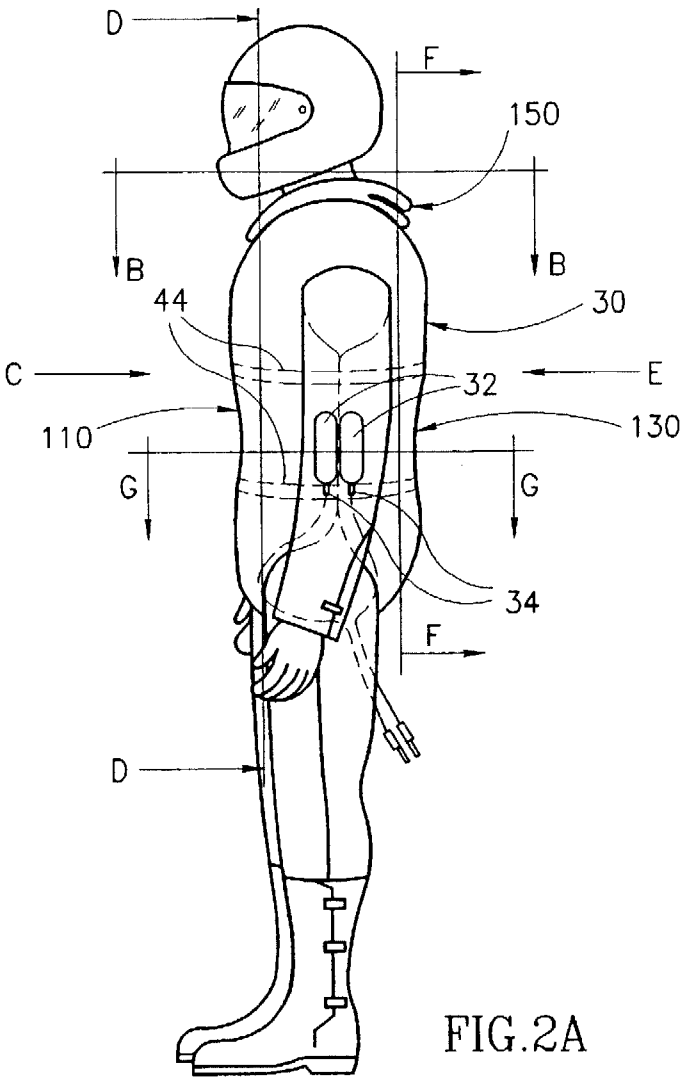
FIG. 2A is a side view of a motorcyclist wearing the system of the invention, wherein the system is in a non-inflated orientation.
Figure 2B:
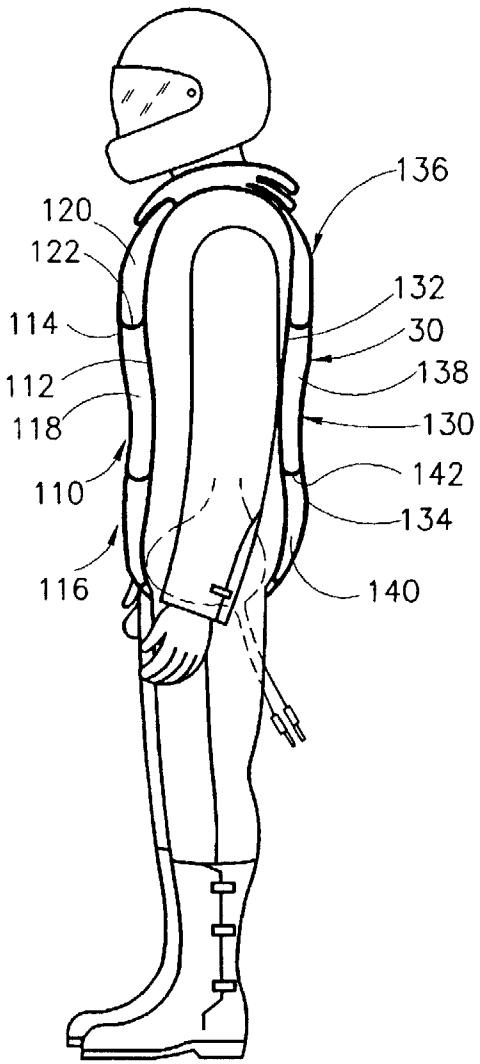
FIG. 2B is a view similar to that of FIG. 2A, but wherein the protective system is seen in side-sectional view, taken along line B—B in FIG. 2A.
Figure 2D:
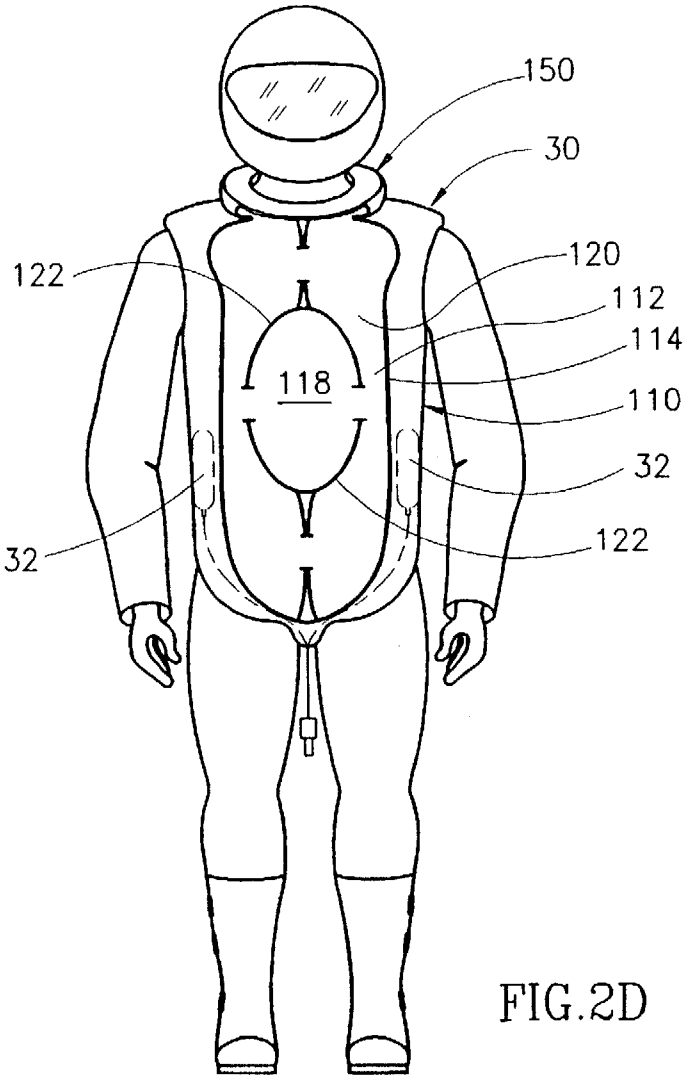
FIG. 2D is a partially cut-away front view of the system of FIG. 2A, taken along line D—D therein.
Figure 2C:
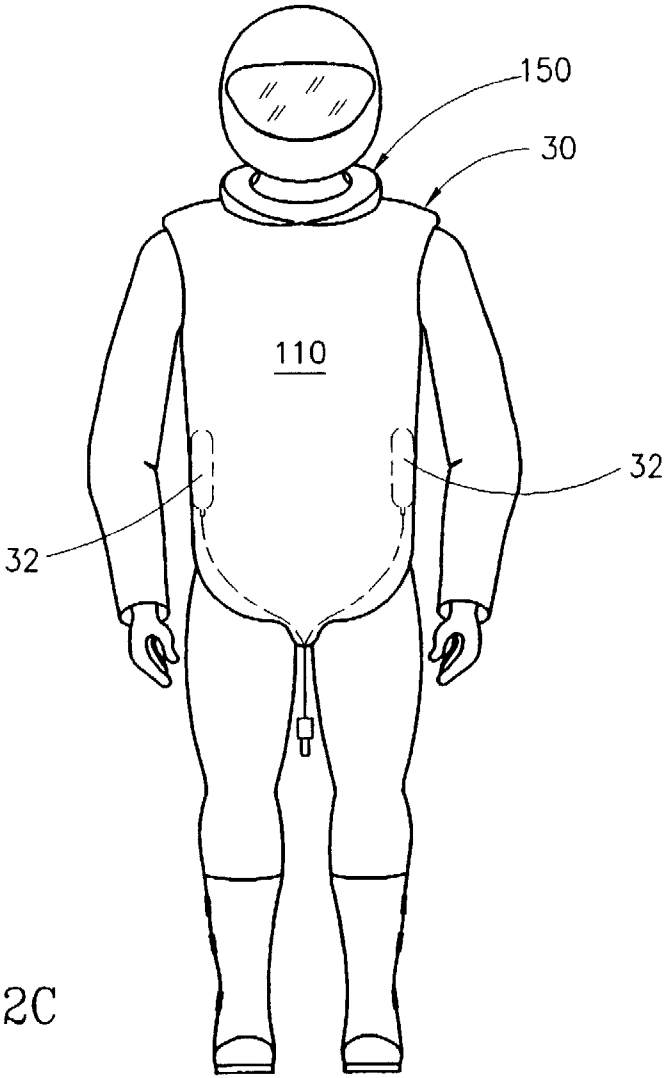
FIG. 2C is a front elevation of the motorcyclist and system of FIG. 2A, taken in the direction of arrow C therein.
Figure 2F:
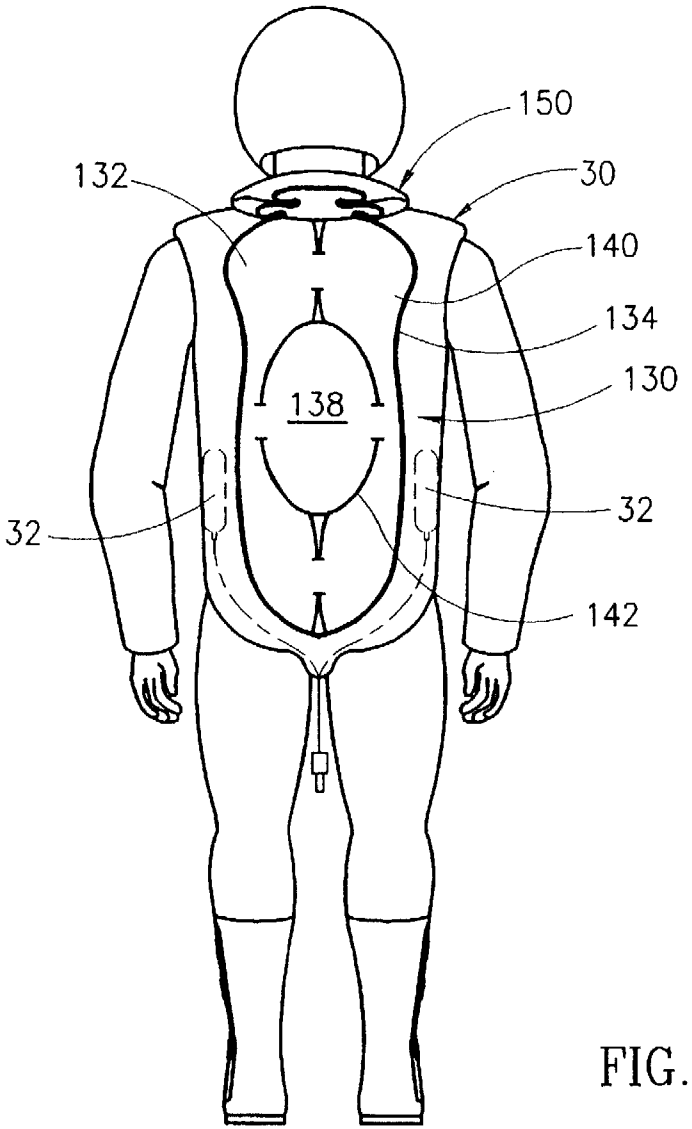
FIG. 2F is a partially cut-away rear view of the system of FIG. 2A, taken along line F—F therein.
Figure 2E:
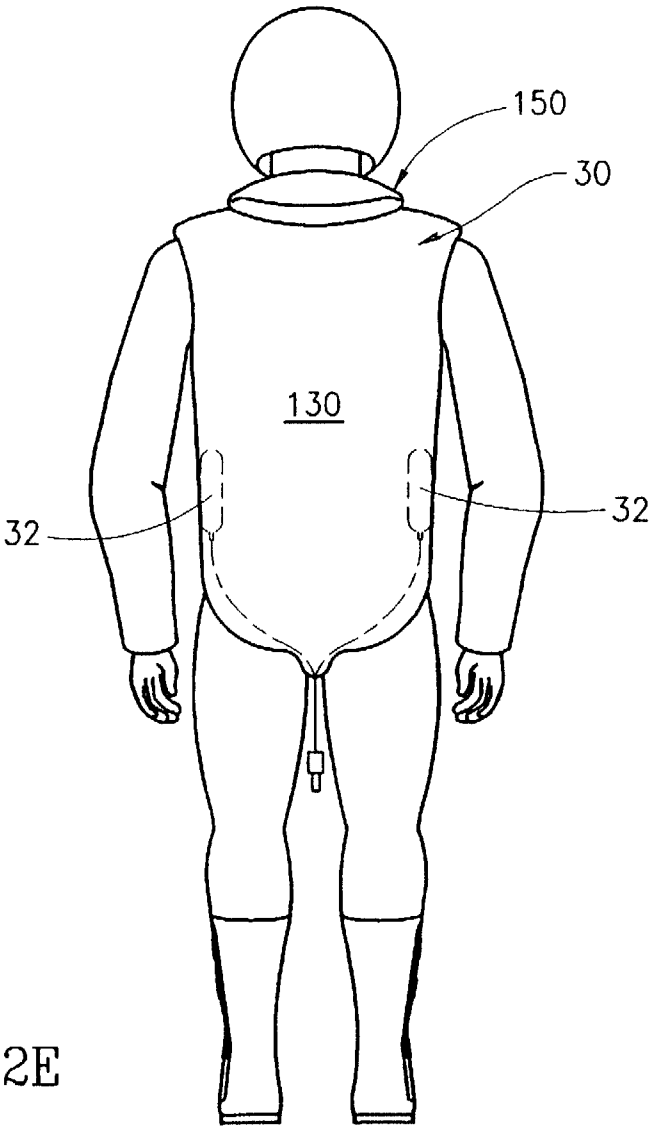
FIG. 2E is a rear elevation of the motorcyclist and system of FIG. 2A, taken in the direction of arrow E therein.
Figure 2G:
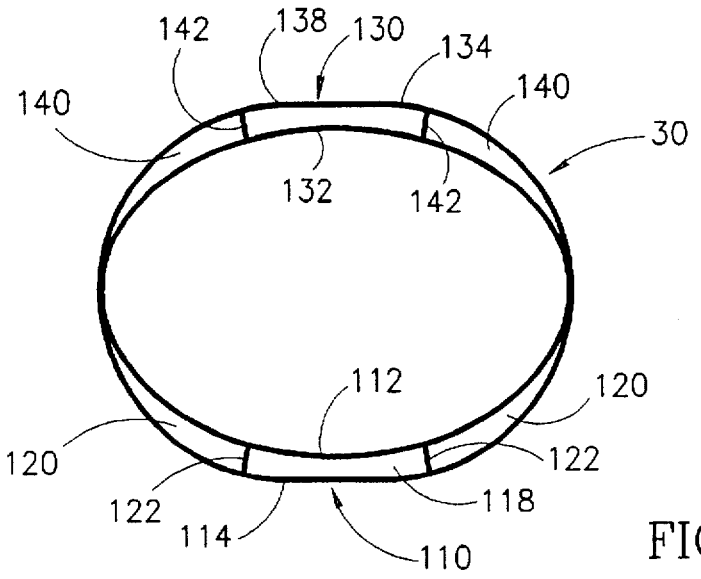
FIG. 2G is a lateral cross-section of the protective system of FIG. 2A, taken along line G—G therein.

After placement of member 30 over the head, portions 110 and 130 are fastened to each other at the sides via any suitable fasteners, but, as shown in FIGS. 4B and 5, preferably by rapid snap-type fasteners having male and female portions, respectively referenced 36 and 38. A further pair of fasteners, referenced 40 and 42, (FIG. 5) is provided for fastening together ends of first and second portions 110 and 130 under the crotch. So as to prevent application to the fabric of member 30 of undesired forces, and so as therefore to avoid tearing thereof, fasteners 36, 38, 40 and 42 are connected to member 30 via a plurality of webbed belt portions 44 (FIGS. 2A and 4A).

Referring now particularly to FIGS. 2B, 2D, 2F, 2G, 3B, 3D, 3F, 3G and 5, the separate portions of inflatable member 30 are formed—in the shape of sealed sacs—of a gas impermeable material, such as a rubberized fabric, or the like, which communicate only with each other, thereby to facilitate rapid inflation.

In the following description, corresponding portions of first and second portions 110 and 130 are referred to by a first reference numeral indicating that portion of first portion 110, followed by a second reference numeral in parenthesis indicting the corresponding portion of second portion 130.

It is thus seen that each of first and second portions 110 and 130 is formed of a gas impermeable interior layer 112(132) configured to lay against a predetermined portion of the rider's body; a gas impermeable exterior layer 114 (134) connected to the interior layer 112(132) so as to form therewith a substantially sealed chamber 116(136), wherein the exterior layer 114(134) is formed of a flexible material which expands in the presence of an elevated gas pressure. Preferably, the chamber 116(136) is divided into typically two gas inflatable cells 118(138) and 120(140) by a gas impermeable wall 122(142) extending laterally between and sealed to the interior and exterior layers 112(132) and 114(134). Preferably, the interior layer 112(132), which is affixed to webbed belt portions 44, is formed of a less expandable material than that of the exterior layer 114(134), such that, while inflatable member 30 expands mainly outwardly, thereby to provide the desired outwardly curved shape, a certain pressure is provided also inwardly, thereby aiding fixation of the back.

The third portion 150, for protecting the neck, has a generally tubular configuration. A rear portion 154 of third portion 150, while having a fairly compact configuration when in a non-inflated orientation, has a generally thickened and raised configuration, seen in FIGS. 3A–3F, when inflated. This thickened portion, which extends for about 270° about the neck from the rear thereof, provides considerable cushioning on impact and, further, helps to fixate the neck and back, in conjunction with the remainder of member 30. Preferably, third portion 150 is formed of a gas impermeable expandable material, similar to that of exterior layer 114(134).

Referring now particularly to FIGS. 3G and 5, it is seen that the portions 150, 160 and 162 and cells 118(138) and 120(140) of portions 110 and 130 are all interconnected via openings 46, thereby to provide gas communication therebetween and rapid inflation thereof upon release of pressurized gas from canisters 32. It is further seen that, in the present example, a plurality of four gas canisters are provided. It will be appreciated, however, that any preferred number of gas canisters may be employed, and that any alternative suitable internal division of inflatable member 30 may be adopted.

In the illustrated embodiment, it is seen that, in each of the first and second inflatable portions 110 and 130, the gas impermeable wall 122(142) extends between the interior and exterior layers 112(132) and 114(134) such that cell 118 (138) has a generally cylindrical configuration, this being surrounded by cell 120(140) which has a generally toroidal configuration. Optionally, toroidal cell 120(140) may also be subdivided as shown.

Referring now particularly to FIGS. 3B and 3G, when inflated, the center 'C' of the exterior layer portion forming the cylindrical cell is at a maximum distance from the interior layer, and the edge portions 128(148) and 129(149) of the exterior layer and the interior layer are separated by only a minimum distance, corresponding to the height of intervening wall portion 122'(142'), such that the portion of the exterior layer between the center C and the edge portions has a curved, convex configuration.

Figures 6A, 6B, 6C:
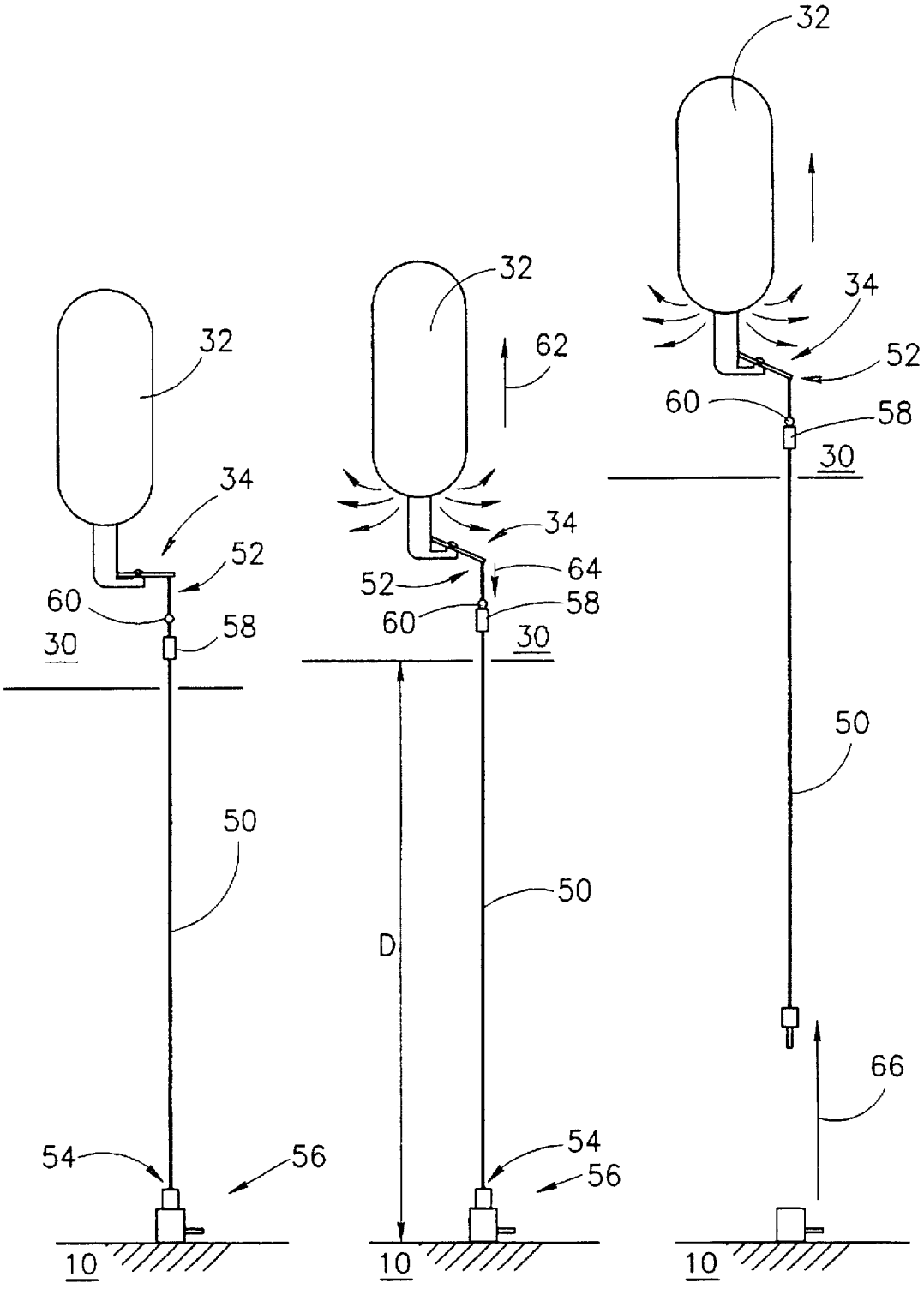
FIGS. 6A, 6B and 6C are schematic illustrations of the inflation and release mechanism of the system of the invention.

Referring now to FIGS. 6A–6C, there is seen, in schematic form, first, inflation of inflatable member 30, and second, release thereof from vehicle 10, in response to separation of a rider wearing the member 30 from vehicle 10, by a distance exceeding a predetermined distance 'D' (FIG. 6B).

Referring initially to FIG. 6A, it is seen that, in the present embodiment, inflatable member 30 is connected to vehicle 10 by means of a cord 50. It will be appreciated from the description hereinbelow in conjunction with FIGS. 8A–9B that, in the present embodiment, and by way of example only, each pair of gas canisters 34 located in the same first or second portion of the inflatable member 30 while being operated by a corresponding pair of gas release mechanism 34, has associated therewith only a single cord 50, the two pairs of gas canisters employed in the present embodiment thus requiring a corresponding pair of cords 50. In the present description of FIGS. 6A–6C, however, a single cord 50 connected to a single gas canister 32 is described, by way of illustrative example only, and the description herein is intended to cover the more specific detail provided below in conjunction with FIGS. 8A–9B.

At a first end 52, cord 50 is attached to gas release mechanism 34 and, at a second end 54, cord 50 is attached to vehicle 10 via a connector 56. A guide 58 for cord 50 is mounted onto an interior portion of inflatable member 30, there being provided a stop element 60 at a predetermined position along cord 50.

Referring now to FIG. 6B, in the event of a collision or other event which causes the rider to suddenly leave his vehicle involuntarily and under a separation force of elevated magnitude, member 30, together with gas canister 32, release mechanism 34 and cord guide 58 are moved suddenly away from vehicle 10, as shown by arrow 62. Once the predetermined separation distance D has been reached, this being, for example, between 60 cm and 1.0 m, cord 50 becomes taut, and the force of the separation (of the rider from the vehicle) is applied along cord 50, thereby to cause activation of the gas release mechanism 34 and release of gas from canister 32. After activation of the gas release mechanism, cord 50 moves downwardly through guide 58, as shown by arrow 64, until stop element 60 engages the guide and is forced to stop. At this point, the separation force is applied along cord 50 to connector 56 which, in the presence of at least a predetermined separation force, releases second end 54 of cord 50, thereby completely releasing the inflating member 30 from vehicle 10. This is indicated in FIG. 6C by arrow 66.

Figure 7A:
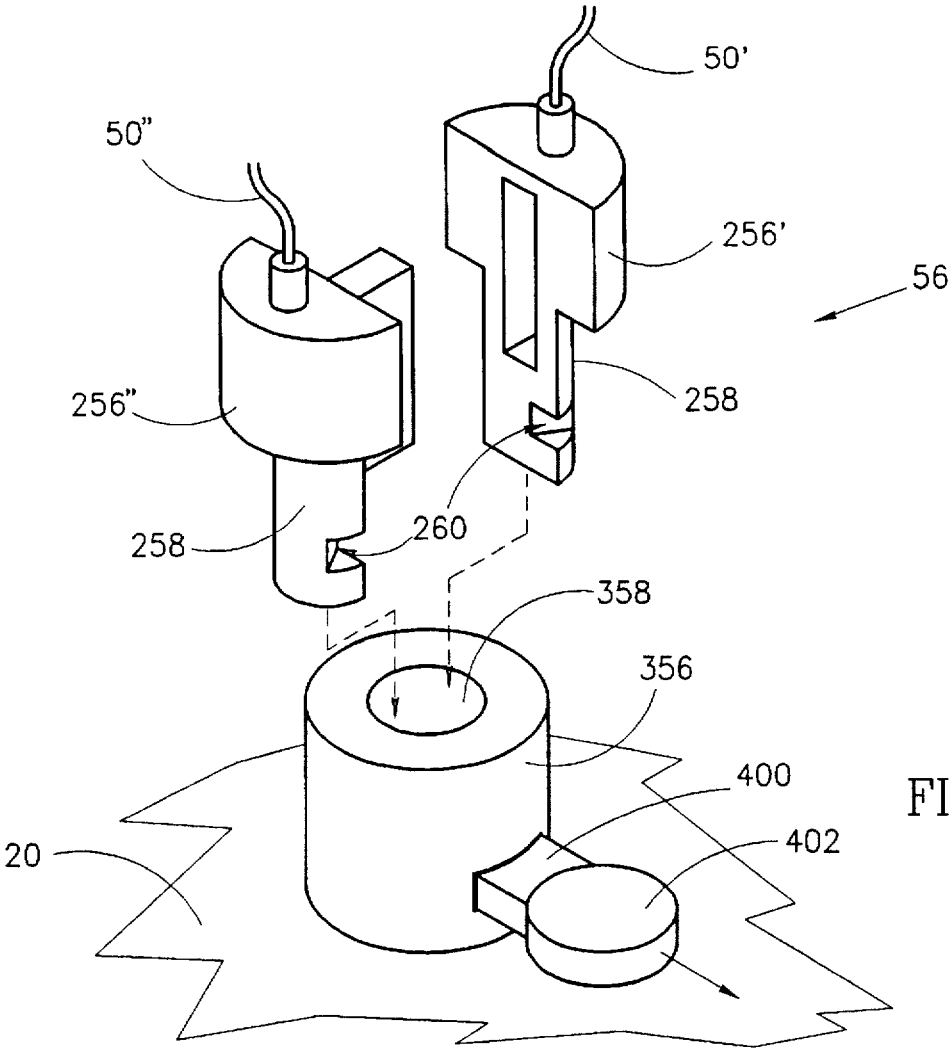
FIG. 7A is an illustration of apparatus for fastening the system of the invention to a motorcycle, in an unfastened orientation.
Figure 7B:
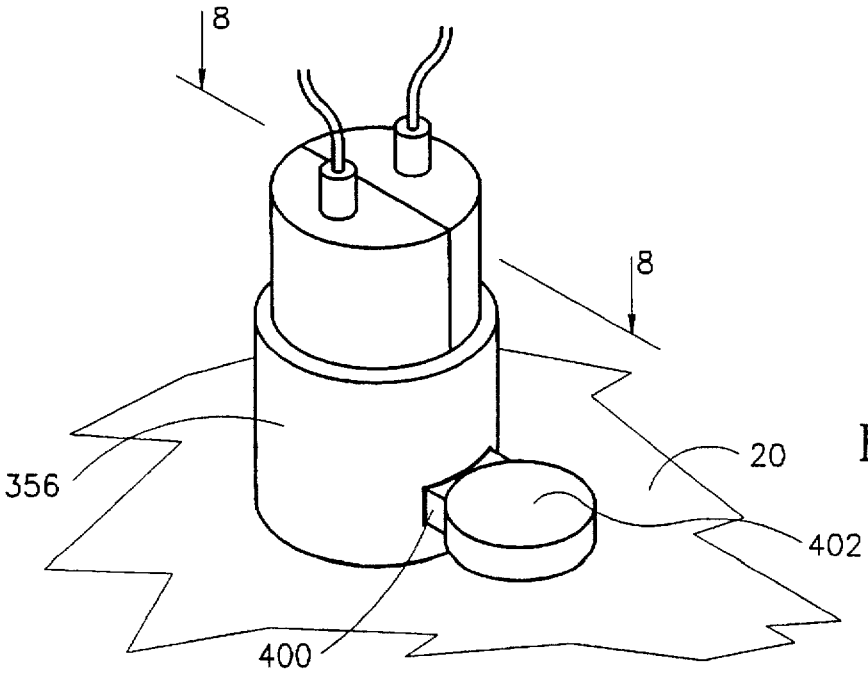
FIG. 7B is an illustration of the fastening apparatus seen in FIG. 7A, in a fastened orientation.
Figure 9B:
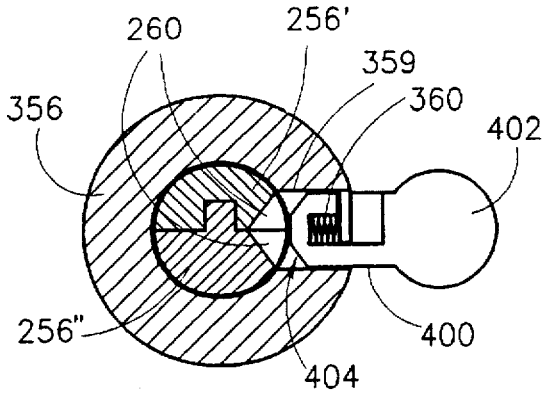
FIGS. 9A and 9B are sectional views of the fastening apparatus of FIGS. 7A–8B corresponding to the views shown in FIGS. 8A and 8B, but in a non-emergency release orientation.
Figure 8B:
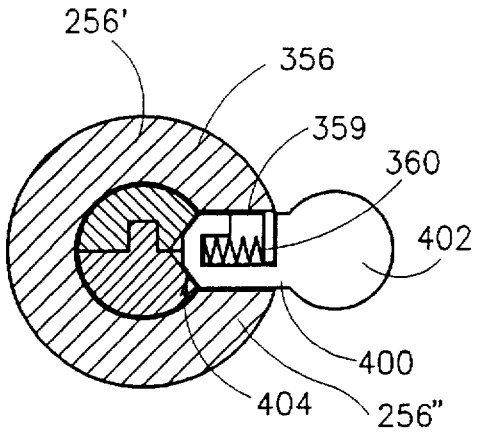
FIG. 8B is a horizontal cross-section of the fastening apparatus as seen in FIG. 8A, taken along line B—B therein.
Figure 9A:
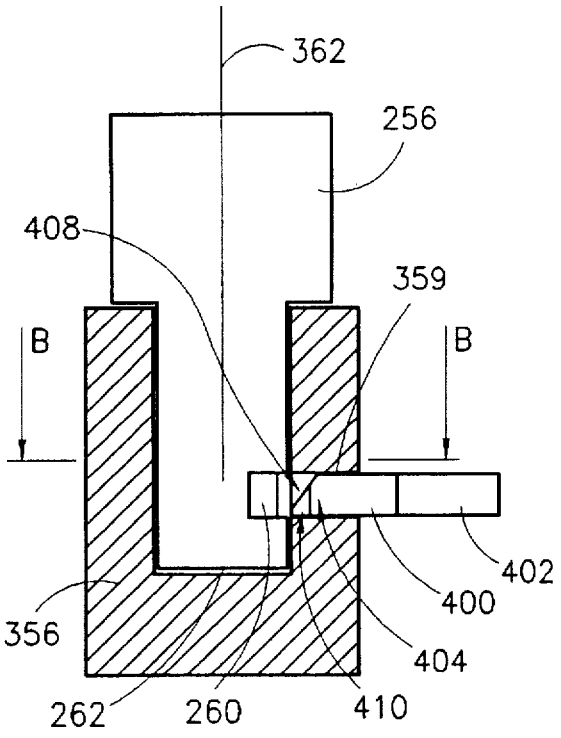
Figure 8A:
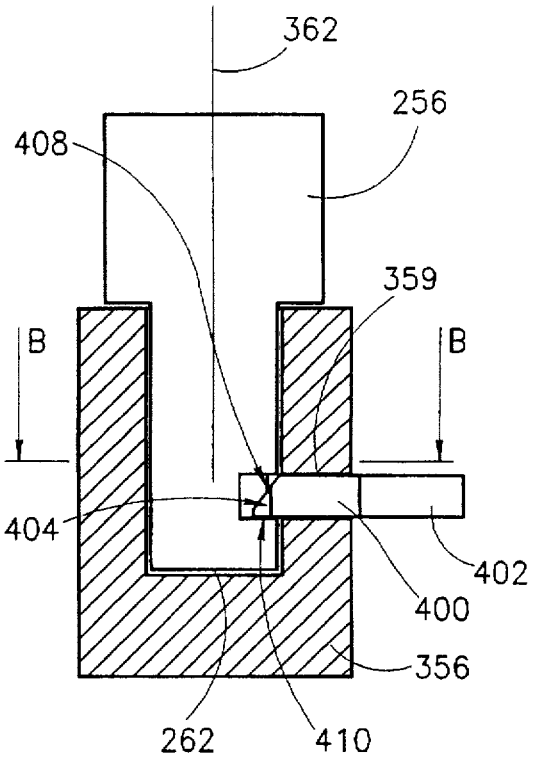
FIG. 8A is a vertical cross-section of the fastening apparatus of FIGS. 8A and 8B, taken along line 8—8 in FIG. 7B.

As indicated above, each pair of gas canisters 32, namely, the pair mounted in first inflatable portion 110 of inflatable member 30, and the pair mounted in second inflatable portion 130 of inflatable member 130, is connected to connector 56 by a separate cord. In FIGS. 7A and 7B these cords are respectively referenced 50' and 50".

As seen in the drawings, connector 56 has a first mating portion 356 fixedly mounted onto a predetermined vehicle portion, such as onto a portion of the chassis 20, and a pair of second mating portions, 256' and 256", respectively attached to cords 50' and 50". The second mating portions 256' and 256" are formed for connection to each other, as well as for connection to first mating portion 356.

As seen in the illustrated example, second mating portions 256' and 256" have formed thereon lower portions 258 for insertion into an opening 358 formed in first mating portion 356. A lateral key member 400 is mounted in conjunction with first mating portion 356, and has an outwardly disposed handle portion 402 and an inwardly disposed locking portion 404 which extends into opening 358 of first mating portion via a side opening 359, and which is configured for mating engagement with lower portions 258 of second mating portions 256' and 256", via appropriate notches 260 formed therein. Key member 400 is mounted for movement between a 'closed' position (FIGS. 8A and 8B), wherein it is fully extended into opening 358 in a locking position, and an 'open' position (FIGS. 9A and 9B) wherein it is fully retracted from opening 358. A resilient member 360, typically a tension spring, is provided for retaining key member 400 in a normally closed or locked position. Opening 358 defines an axis 362 along which second mating portions 256' and 256" are inserted and removed from first mating portion 356.

The inner end 404 of key member has an upper, beveled surface 408 which forms an acute angle with respect to the axis 362, and a lower surface 410 which is normal thereto. Accordingly, connection of cords 50' and 50" to the vehicle is provided by simple insertion of second mating portions 256' and 256" into first mating portion 356. As the lower edge 262 of the second mating portions engage beveled surface 408 of key member 400, it is displaced outwardly until notches 260 are brought into registration therewith, and resilient member 360 forces key member 400 into mating engagement therewith.

Subsequently, in the event of a "non-emergency" release, the first and second mating portions may be disconnected by pulling key member 400 outwardly via handle portion 402, and subsequently removing second mating portions 256' and 256" from first mating portion 356.

In the event of an "emergency" release, however, caused by a sudden separation of the rider wearing the inflatable member 30 from vehicle 10, and consequent application of at least a minimum predetermined force to connector 56 via cord 50, connector 56 is adapted to 'fail' mechanically, such that the first and second mating portions separate immediately after release of the pressurized gas.

This may be achieved in any number of ways, although, in the present invention, it is done by making second mating portions 256' and 256" from metal, and key member 400 from any suitable type of brittle plastic such that the relatively thin inner end 404 of key member 400 is frangible. Accordingly, while under normal forces, key member 400 is operative to properly lock the mating portions together, it is easily sheared through when there is applied thereto a high magnitude separation force such as results from a collision.

It will be appreciated by persons skilled in the art that the scope of the present invention is not limited by what has been shown and described hereinabove, merely by way of example. Rather, the scope of the present invention is limited solely by the claims, which follow:

We claim:

1. A protective system for the rider of a non-enclosed vehicle comprising:

a garment-shaped inflatable member for surrounding at least upper portions of the body of a rider of a non-enclosed vehicle and including first and second inflatable portions for covering and protecting respective front and rear portions of the body and at least a third inflatable portion for covering and protecting at least a back portion of a neck of the rider, each of said first and second inflatable portions comprising:

a gas impermeable interior layer configured to lay against a predetermined portion of the rider's body;

a gas impermeable exterior layer connected to said interior layer so as to form therewith a substantially sealed chamber, wherein said exterior layer is formed of a flexible material which expands in the presence of an elevated gas pressure; and at least one gas impermeable wall extending laterally between and sealed to said interior and exterior layers, thereby to divide said sealed chamber into at least two gas inflatable cells, wherein said at least one gas impermeable wall extends between said interior and exterior layers so as to form therewith a generally central generally cylindrical cell surrounded by a generally toroidal cell;

a source of pressurized gas incorporated in said inflatable member; and means for exposing the interior of said inflatable member to said pressurized gas source for rapidly inflating said inflatable member in response to a sudden separation of the rider from the vehicle by at least a predetermined distance, wherein said inflatable member has a garment-shaped configuration when in a non-inflated orientation, and which when inflated, has an expanded, generally bulbous configuration such that large magnitude concentrated forces experienced thereby on impact with an object subsequent to the sudden separation of the rider from the vehicle are prevented from transfer directly to the rider, thereby protecting the surrounded upper portions of the rider's body from serious injury.

2. A system according to claim 1, wherein, when said cylindrical cell is inflated the perpendicular distance between a central portion of said exterior layer and said interior layer is a first distance, and when said toroidal cell is inflated the perpendicular distance between edge portions of said exterior layer and said interior layer is a second distance, and wherein said first distance is a maximum and said second distance is a minimum and wherein the said exterior layer between said central portion and said edge portion has a convex configuration.

3. The system according to claim 1, wherein said means for exposing comprises:

connector means for selectably connecting said inflatable member to the vehicle;

gas release means associated with said source of pressurized gas; and mechanical operating means associated with said gas release means and said connector means, and responsive to a sudden separation of the rider from the vehicle by at least a predetermined distance to activate said gas release means so as to inflate said inflatable member and so as also to disconnect said inflatable member from the vehicle.

4. A protective system for the rider of a non-enclosed vehicle comprising:

a garment-shaped inflatable member for surrounding at least upper portions of the body of a rider of a non-enclosed vehicle;

a source of pressurized gas incorporated in said inflatable member; and means for exposing the interior of said inflatable member to said pressurized gas source for rapidly inflating said inflatable member in response to a sudden separation of the rider from the vehicle by at least a predetermined distance, said means for exposing including:

connector means for selectable connecting said inflatable member to the vehicle;

gas release means associated with said source of pressurized gas; and mechanical operating means associated with said gas release means and said connector means, and responsive to a sudden separation of the rider from the vehicle by at least a predetermined distance to activate said gas release means so as to inflate said inflatable member and so as also to disconnect said inflatable member from the vehicle, wherein said inflatable member has a garment-shaped configuration when in a non-inflated orientation, and which when inflated, has an expanded, generally bulbous configuration such that large magnitude concentrated forces experienced thereby on impact with an object subsequent to the sudden separation of the rider from the vehicle are prevented from transfer directly to the rider, thereby protecting the surrounded upper portions of the rider's body from serious injury, wherein said connector means comprises:

fastener means, associated with said operating means, for fastening said inflatable member to the vehicle; and means for selectably unfastening said inflatable means from the vehicle, wherein said fastener means comprises a first mating portion mounted onto the vehicle and at least one second mating portion, including frangible means matingly engageable with said first mating portion, for connecting said operating means to said first mating portion, wherein, in response to a sudden separation of the rider from the vehicle operative to apply at least a predetermined force to said connector means, said operating means is operative to transmit said force, first, to said gas release means so as to cause operation thereof, and, second, to said source of pressurized gas so as to inflate said inflatable member and subsequently, to said frangible means, thereby to cause shearing thereof and disengagement thereof from said first mating portion, thereby permitting disconnection of said inflatable member from the vehicle.

5. A system according to claim 4, wherein said operating means comprises a cord of predetermined length.

6. A system according to claim 4, wherein said garment-shaped inflatable member is configured to cover and protect at least the portion of the body extending from the pelvis to the neck.

7. The system according to claim 4, wherein said inflatable member comprises first and second inflatable portions for covering and protecting respective front and rear portions of the body and at least a third inflatable portion for covering and protecting at least a back portion of a neck of the rider.

8. A system according to claim 7, wherein said first, second and third inflatable portions are also operative to fixate body portions surrounded thereby, when in said inflated orientation.

9. A system according to claim 7, wherein each of said first and second inflatable portions comprises:

a gas impermeable interior layer configured to lay against a predetermined portion of the rider's body;

a gas impermeable exterior layer connected to said interior layer so as to form therewith a substantially sealed chamber, wherein said exterior layer is formed of a flexible material which expands in the presence of an elevated gas pressure; and at least one gas impermeable wall extending laterally between and sealed to said interior and exterior layers, thereby to divide said sealed chamber into at least two gas inflatable cells.

10. A system according to claim 9, wherein said at least two gas inflatable cells have formed therebetween openings so as to permit gas communication therebetween, and wherein said source of pressurized gas comprises at least one pressurized gas canister located in gas flow communication with at least one of said gas inflatable cells, wherein activation of said means for exposing causes an increase in pressure in each said cell to a predetermined pressure.

11. A combination of a protective system and a non-enclosed vehicle comprising:

a non-enclosed vehicle comprising:

a chassis; and a plurality of wheels associated with said chassis; and a protective system for a rider of said vehicle, said protective system comprising:

a garment-shaped inflatable member for surrounding at least upper portions of the body of a rider of said non-enclosed vehicle and including first and second inflatable portions for covering and protecting respective front and rear portions of the body and at least a third inflatable portion for covering and protecting at least a back portion of a neck of the rider, each of said first and second inflatable portions comprising:

a gas impermeable interior layer configured to lay against a predetermined portion of the rider's body;

a gas impermeable exterior layer connected to said interior layer so as to form therewith a substantially sealed chamber, wherein said exterior layer is formed of a flexible material which expands in the presence of an elevated gas pressure; and at least one gas impermeable wall extending laterally between and sealed to said interior and exterior layers, thereby to divide said sealed chamber into at least two gas inflatable cells, wherein said at least one gas impermeable wall extends between said interior and exterior layers so as to form therewith a generally central generally cylindrical cell surrounded by a generally toroidal cell;

a source of pressurized gas incorporated in said inflatable member; and means for exposing the interior of said inflatable member to said pressurized gas source for rapidly inflating said inflatable member in response to a sudden separation of the rider from the vehicle by at least a predetermined distance, wherein said inflatable member has a garment-shaped configuration when in a non-inflated orientation, and which when inflated, has an expanded generally bulbous configuration such that large magnitude concentrated forces experienced thereby on impact with an object subsequent to the sudden separation of the rider from the vehicle are prevented from transfer directly to the rider, thereby protecting the surrounded upper portions of the rider's body from serious injury, said protective system being releasably coupled to said vehicle.

12. A combination according to claim 11, wherein, when said cylindrical cell is inflated the perpendicular distance between a central portion of said exterior layer and said interior layer is a first distance, and when said toroidal cell is inflated the perpendicular distance between edge portions of said exterior layer and said interior layer is a second distance, and wherein said first distance is a maximum and said second distance is a minimum and wherein the said exterior layer between said central portion and said edge portion has a convex configuration.

13. The combination according to claim 11, wherein said means for exposing comprises:

connector means for selectably connecting said inflatable member to the vehicle;

gas release means associated with said source of pressurized gas; and mechanical operating means associated with said gas release means and said connector means, and responsive to a sudden separation of the rider from the vehicle by at least a predetermined distance to activate said gas release means so as to inflate said inflatable member and so as also to disconnect said inflatable member from the vehicle.

14. A combination of a protective system and a non-enclosed vehicle comprising:

a non-enclosed vehicle comprising:

a chassis; and a plurality of wheels associated with said chassis; and a protective system for a rider of said vehicle, said protective system comprising:

a garment-shaped inflatable member for surrounding at least upper portions of the body of a rider of said non-enclosed vehicle;

a source of pressurized gas incorporated in said inflatable member; and means for exposing the interior of said inflatable member to said pressurized gas source for rapidly inflating said inflatable member in response to a sudden separation of the rider from the vehicle by at least a predetermined distance, said means for exposing comprising:

connector means for selectable connecting said inflatable member to a predetermined portion of said vehicle;

gas release means associated with said source of pressurized gas; and mechanical operating means associated with said gas release means and said connector means, and responsive to a sudden separation of the rider from said vehicle by at least a predetermined distance to activate said gas release means so as to inflate said inflatable member and so as also to disconnect said inflatable member from said predetermined vehicle portion;

wherein said inflatable member has a garment-shaped configuration when in a non-inflated orientation, and which when inflated, has an expanded, generally bulbous configuration such that large magnitude concentrated forces experienced thereby on impact with an object subsequent to the sudden separation of the rider from said vehicle are prevented from transfer directly to the rider, thereby protecting the surrounded upper portions of the rider's body from serious injury, said protective system being releasably coupled to said vehicle;

wherein said connector means comprises:

fastener means, associated with said operating means, for fastening said inflatable member to said predetermined vehicle portion; and means for selectably unfastening said inflatable means from said predetermined vehicle portion, wherein said fastener means comprises a first mating portion mounted onto the vehicle and at least one second mating portion, including frangible means matingly engageable with said first mating portion, for connecting said operating means to said first mating portion, wherein, in response to a sudden separation of the rider from said vehicle operative to apply at least a predetermined force to said connector means, said operating means is operative to transmit said force, first, to said gas release means so as to cause operation thereof, and, second, to said source of pressurized gas so as to inflate said inflatable member and subsequently, to said frangible means, thereby to cause shearing thereof and disengagement thereof from said first mating portion, thereby permitting disconnection of said inflatable member from said vehicle.

15. A combination according to claim 14, wherein said operating means comprises a cord of predetermined length.

16. The combination according to claim 14, wherein said inflatable member comprises first and second inflatable portions for covering and protecting respective front and rear portions of the body and at least a third inflatable portion for covering and protecting at least a back portion of a neck of the rider.

* * * * *

UNITED STATES PATENT AND TRADEMARK OFFICE

CERTIFICATE OF CORRECTION

PATENT NO. : 5,781,936

DATED : July 21, 1998

INVENTOR(S) : Jacob Alaloof

It is certified that error appears in the above-identified patent and that said Letters Patent is hereby corrected as shown below:

Column 9, line 43: please delete "selectable", and insert --selectably-- therefor.

Column 12, line 9: please delete "selectable" and insert --selectably-- therefor.

Signed and Sealed this

Twenty-seventh Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,781,936

DATED : July 21, 1998

INVENTOR(S) : Jacob Alaloof

It is certified that error appears in the above-indentified patent and that said Letters Patent is hereby corrected as shown below:

On title page: Item [54] and Column 1, line 1, delete " Projection " and insert --Protection--therefor.

Signed and Sealed this

Third Day of April, 2001

*Attest:*

Nicholas P. Godici

NICHOLAS P. GODICI

*Attesting Officer*

*Acting Director of the United States Patent and Trademark Office*